US011078701B2

(12) United States Patent
Nuss

(10) Patent No.: US 11,078,701 B2
(45) Date of Patent: Aug. 3, 2021

(54) LINEAR HINGE FOR AN APPLIANCE

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 396 days.

(21) Appl. No.: 16/239,715

(22) Filed: Jan. 4, 2019

(65) Prior Publication Data

US 2020/0217115 A1 Jul. 9, 2020

(51) Int. Cl.
*F25D 23/02* (2006.01)
*E05D 7/04* (2006.01)

(52) U.S. Cl.
CPC ..... *E05D 7/043* (2013.01); *F25D 23/028* (2013.01); *E05Y 2900/31* (2013.01); *F25D 2323/024* (2013.01)

(58) Field of Classification Search
CPC ..... E05Y 2900/31; F25D 23/028; F25D 2324/024; F25D 2323/021; F25D 23/02; F25D 2323/024; E05D 7/043; E05D 3/06
See application file for complete search history.

(56) References Cited

U.S. PATENT DOCUMENTS 5,040,857 A * 8/1991 Mandel ..... E05D 3/022 312/405
6,845,545 B2 1/2005 Han et al.
10,822,852 B1 * 11/2020 Nuss ..... E05D 3/022
2004/0040118 A1 * 3/2004 Han ..... E05F 1/14 16/277
2005/0212392 A1 * 9/2005 Jung ..... E05D 11/1064 312/405
2010/0283367 A1 * 11/2010 Coleman ..... E05D 3/022 312/405
2016/0245579 A1 * 8/2016 Eom ..... F25D 23/028
2018/0148962 A1 * 5/2018 Jung ..... E05D 11/06
2018/0283077 A1 * 10/2018 Lee ..... E05F 15/70

FOREIGN PATENT DOCUMENTS

CN 104949442 A 9/2015
EP 2712995 B1 8/2015
KR 20040006118 A 1/2004
KR 20130119274 A 10/2013

* cited by examiner

*Primary Examiner* — Hiwot E Tefera
(74) *Attorney, Agent, or Firm* — Dority & Manning, P.A.

(57) ABSTRACT

An appliance includes a linear hinge that couples a door to a cabinet. The linear hinge includes a bearing and an elongated shaft received within the bearing such that the elongated shaft is slidable along a translation axis. A distal end portion of the elongated shaft is rotatably connected to the door such that the door is rotatable about a rotation axis that extends through the distal end portion of the elongated shaft. A first linkage arm is rotatably connected to the bearing. A second linkage arm is rotatably connected to the elongated shaft and to the first linkage arm. The distal end portion of the elongated shaft is spaced from the bearing by a gap along the translation axis when the door is closed, and a sum of a length of the first linkage arm and a length of the second linkage arm is greater than the gap.

18 Claims, 5 Drawing Sheets

LINEAR HINGE FOR AN APPLIANCE

FIELD OF THE INVENTION

The present subject matter relates generally to linear hinges.

BACKGROUND OF THE INVENTION

Integrated refrigerator appliances allow panels to be mounted on doors of the integrated refrigerator appliances. The panels may sit flush with adjacent cabinetry when the doors are closed. The doors in integrated refrigerator appliances are frequently mounted on hinges such that the doors rotate open and closed.

Linear hinges allow the doors to translate away from adjacent cabinetry in addition to rotating open and closed. By translating in addition to rotating, interference between the doors and the adjacent cabinetry can be avoided. However, known linear hinges have several drawbacks, such as being bulky and allowing hard slamming of the doors.

BRIEF DESCRIPTION OF THE INVENTION

Aspects and advantages of the invention will be set forth in part in the following description, or may be apparent from the description, or may be learned through practice of the invention.

In a first example embodiment, an appliance includes a cabinet and a door. A linear hinge couples the door to the cabinet. The linear hinge includes a bearing mounted to the cabinet. An elongated shaft is received within the bearing such that the elongated shaft is slidable along a translation axis on the bearing. A distal end portion of the elongated shaft is rotatably connected to the door such that the door is rotatable about a rotation axis that extends through the distal end portion of the elongated shaft. The linear hinge also includes a pair of linkage arms. A first linkage arm of the pair of linkage arms is rotatably connected to the bearing such that a first end portion of the first linkage arm is positioned at the bearing. A second linkage arm of the pair of linkage arms is rotatably connected to the elongated shaft such that a first end portion of the second linkage arm is positioned at the distal end portion of the elongated shaft. The first linkage arm is rotatably connected to the second linkage arm such that a second end portion of the first linkage arm is positioned at a second end portion of the second linkage arm. The first linkage arm defines a length between the first and second end portions of the first linkage arm, and the second linkage arm defines a length between the first and second end portions of the second linkage arm. The distal end portion of the elongated shaft is spaced from the bearing by a gap along the translation axis when the door is closed, and a sum of the length of the first linkage arm and the length of the second linkage arm is greater than the gap.

In a second example embodiment, an appliance includes a cabinet and a door. A linear hinge couples the door to the cabinet. The linear hinge includes a bearing mounted to the cabinet. An elongated shaft is received within the bearing such that the elongated shaft is slidable along a translation axis on the bearing. A distal end portion of the elongated shaft is rotatably connected to the door such that the door is rotatable about a rotation axis that extends through the distal end portion of the elongated shaft. The linear hinge also includes a pair of linkage arms. A first linkage arm of the pair of linkage arms is rotatably connected to the bearing such that a first end portion of the first linkage arm is positioned at the bearing. A second linkage arm of the pair of linkage arms is rotatably connected to the elongated shaft such that a first end portion of the second linkage arm is positioned at the distal end portion of the elongated shaft. The first linkage arm is rotatably connected to the second linkage arm such that a second end portion of the first linkage arm is positioned at a second end portion of the second linkage arm. The first linkage arm defines a length between the first and second end portions of the first linkage arm, and the second linkage arm defines a length between the first and second end portions of the second linkage arm. The length of the second linkage arm is oriented perpendicular to the translation axis when the door is closed. The distal end portion of the elongated shaft is spaced from the bearing by a gap along the translation axis when the door is closed, and a sum of the length of the first linkage arm and the length of the second linkage arm is greater than the gap. The length of the first linkage arm is greater than the length of the second linkage arm. The length of the first linkage arm and the length of the second linkage arm are selected such that the door translates along the translation axis as the door rotates from a closed position towards an open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
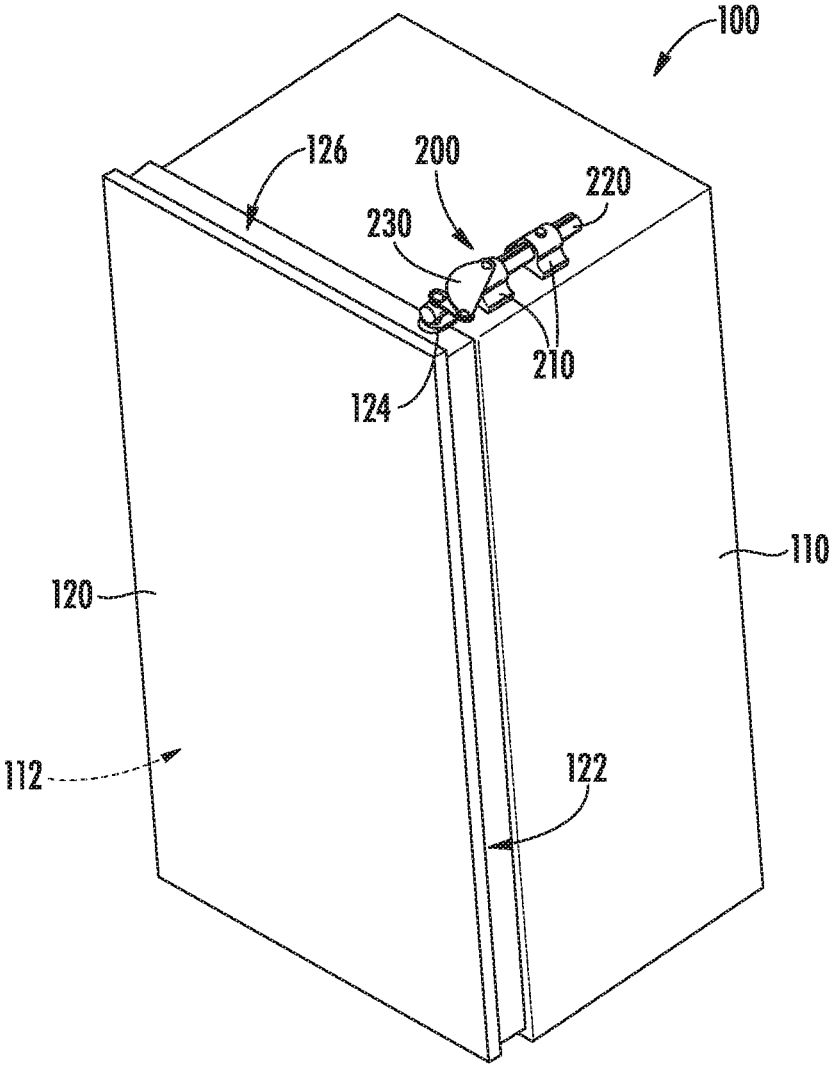
FIG. 1 is a perspective view of an appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an appliance 100 according to an example embodiment of the present subject matter. As may be seen in FIG. 1, appliance 100 includes a base or cabinet 110 and a door 120. Door 120 is coupled to cabinet 110 with one or more linear hinges 200, e.g., at a top and bottom of door 120. A user may rotate door 120 open to access and interior of cabinet 110, and the user may rotate door 120 closed to seal the interior of cabinet 110.

In certain example embodiments, appliance 100 may be a refrigerator appliance. Thus, e.g., cabinet 110 may be an insulated cabinet with a chilled chamber 112 positioned within cabinet 110. A sealed system (not shown) may be operable to cool chilled chamber 112 and food items stored therein. It will be understood that appliance 100 may be any other type of appliance in alternative example embodiments. In particular, while described in greater detail below in the context of appliance 100, it will be understood that linear hinge 200 may be used in or with any suitable appliance in alternative example embodiments. For example, linear hinge 200 may be used in or with French door oven appliances, dishwasher appliances, etc. to mount a door to a cabinet, such as a base, a tub, etc. As discussed in greater detail herein, linear hinge 200 includes features for limiting hard slamming of door 120 and/or is less bulky than known hinges.

Figure 2:
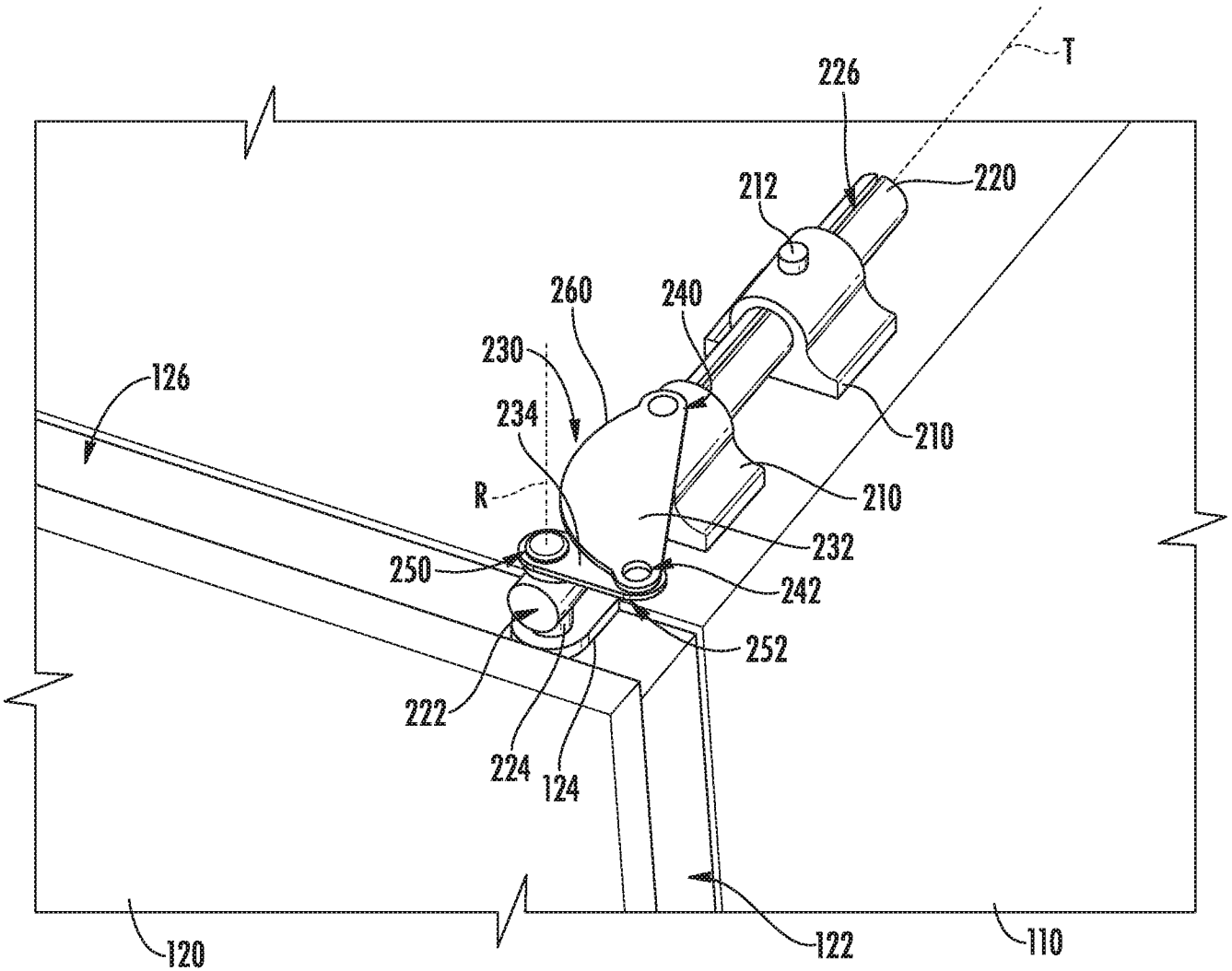
FIG. 2 is a perspective view of a linear hinge of the example appliance of FIG. 1.
Figure 3:
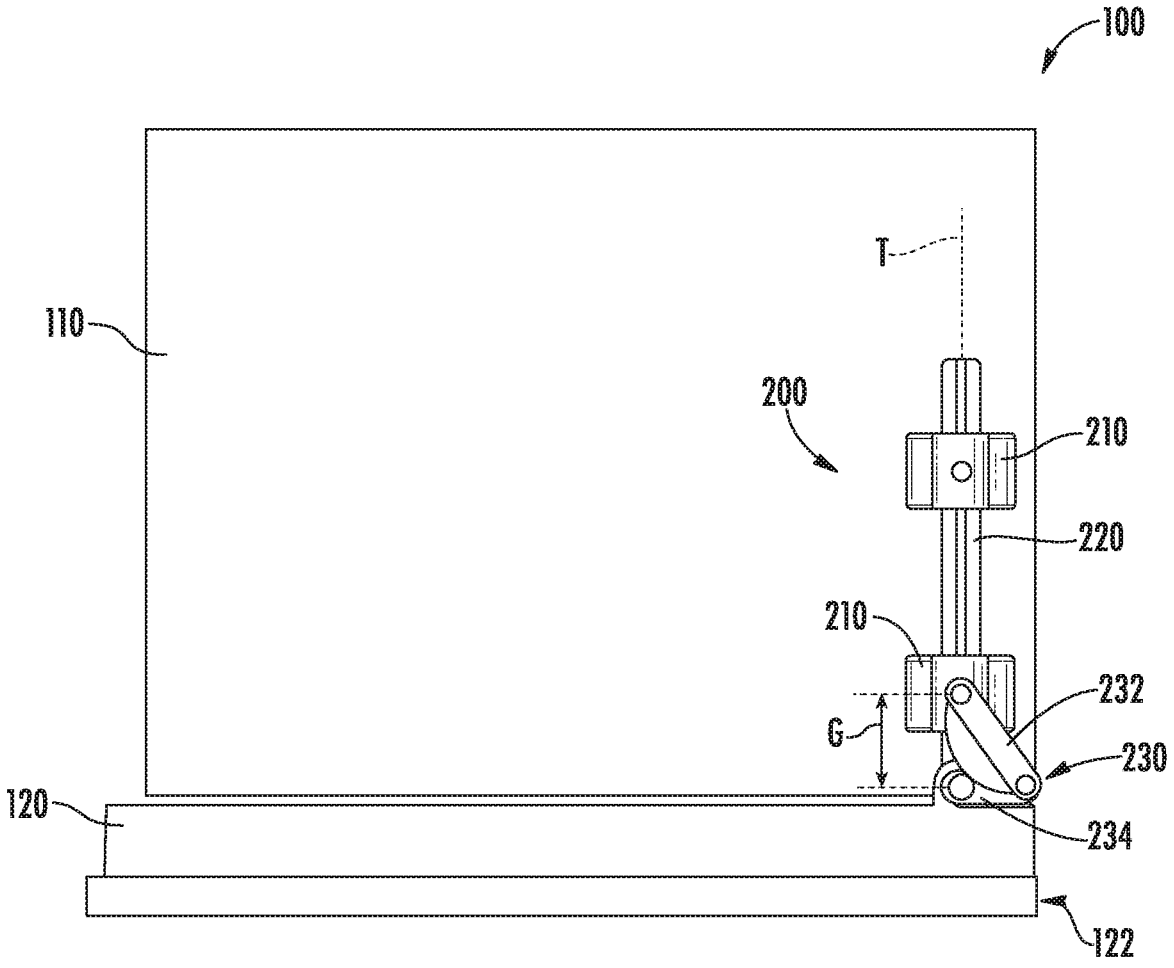
FIGS. 3 through 5 are top, plan views of the example appliance of FIG. 1 with a door shown in various positions.
Figure 4:
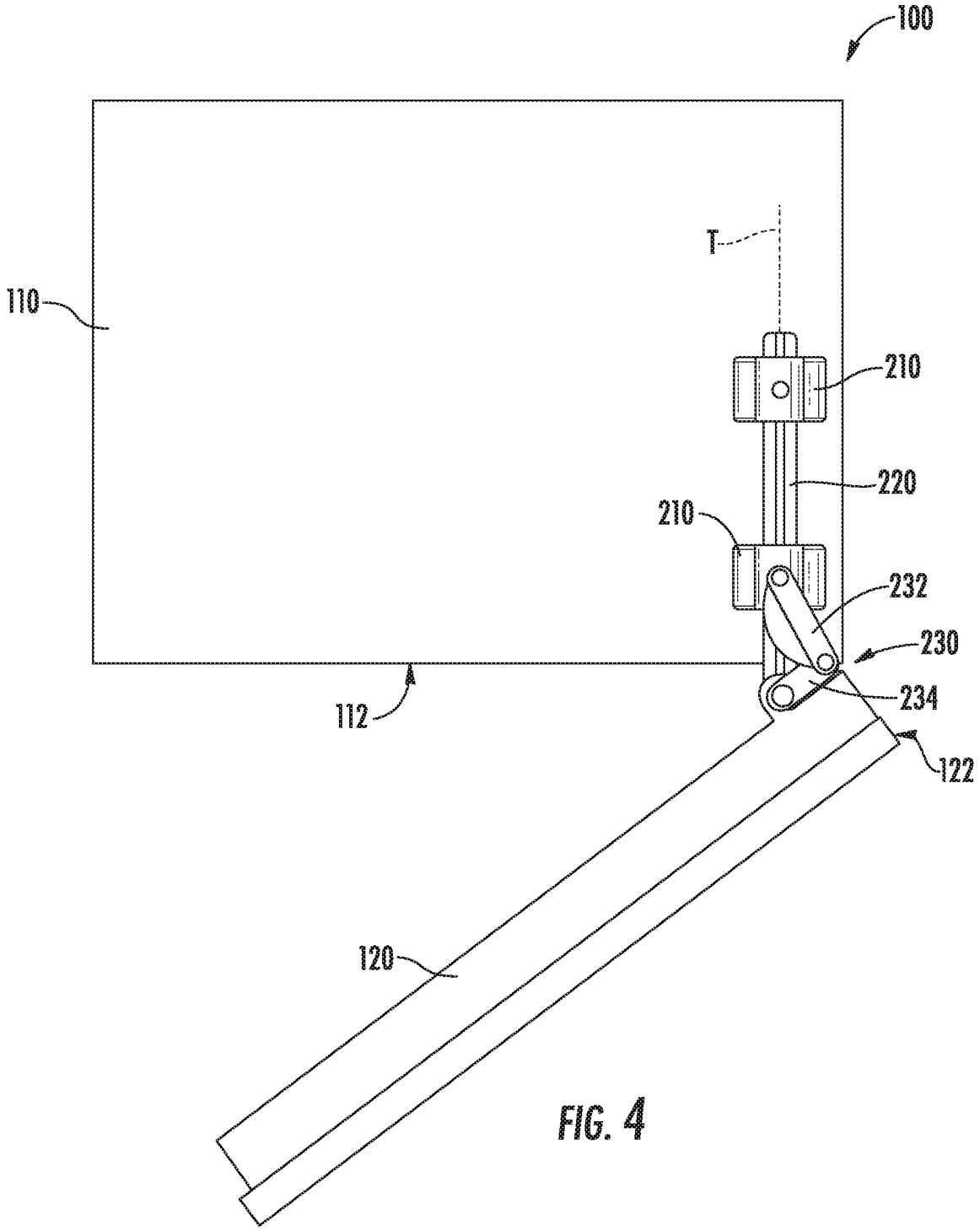
Figure 5:
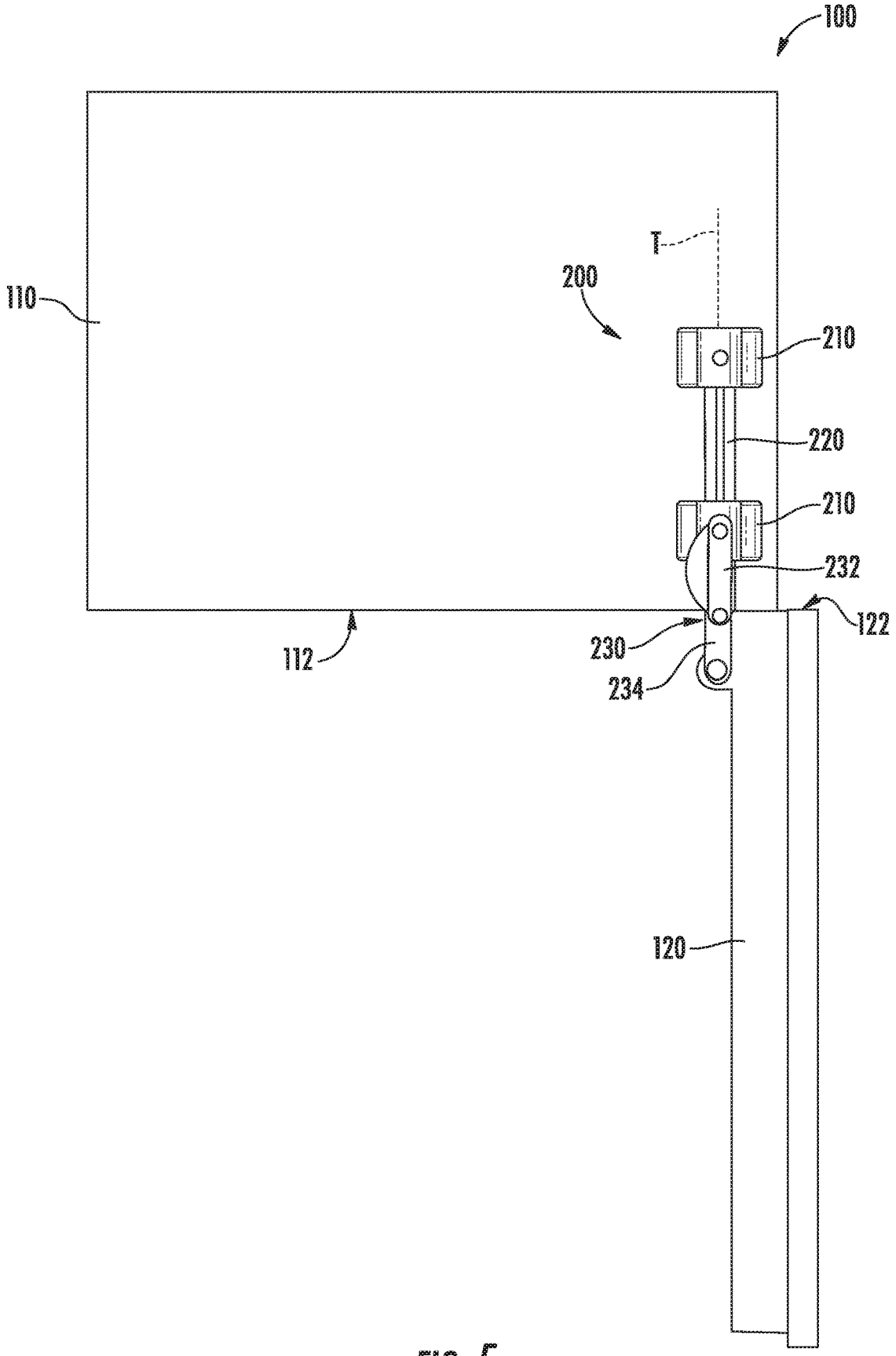

FIG. 2 is a perspective view of linear hinge 200. FIGS. 3 through 5 are top, plan views of appliance 100 with door 120 shown in various positions. As may be seen in FIG. 2, linear hinge 200 includes at least one bearing 210, an elongated shaft 220, and a pair of linkage arms 230. Bearing 210 is mounted to cabinet 110. As an example, bearing 210 may be fastened or otherwise suitably fixed to cabinet 110. Elongated shaft 220 is received within bearing 210. In particular, elongated shaft 220 may slide along a translation axis T on bearing 210. Thus, e.g., elongated shaft 220 may extend and retract along the translation axis T on bearing 210 as door 120 opens and closes.

A distal end portion 222 of elongated shaft 220 may be cantilevered from bearing 210, and distal end portion 222 of elongated shaft 220 is rotatably connected to door 120. In particular, door 120 is rotatable about a rotation axis R that extends through distal end portion 222 of elongated shaft 220. The rotation axis R may be perpendicular to the translation axis T. For example, the rotation axis R may be vertically oriented, and the translation axis T may be horizontally oriented.

As shown in FIGS. 3 through 5, door 120 is connected to cabinet 110 with linear hinge 200 such that door 120 is translatable along the translation axis T relative to cabinet 110 and is also rotatable about the rotation axis R relative to cabinet 110. Thus, e.g., when door 120 includes an outer panel that is flush mounted with adjacent cabinetry, linear hinge 200 may translate door 110 along the translation axis T away from cabinet 110 as door 110 is rotated open about the rotation axis R. Translating door 120 away from cabinet 110 as door 120 rotates open assists with reducing interference between door 120 and adjacent cabinetry. In addition, translating door 120 away from cabinet 110 as door 120 rotates open may also assist with limiting scraping of door 120 on a gasket (not shown) that extends between cabinet 110 and door 120 to seal the interior of cabinet 110.

Linkage arms 230 couple elongated shaft 220 to bearing 210 to induce sliding of elongated shaft 220 along the translation axis T on bearing 210 (and thus door 120) as door 120 is rotated open about the rotation axis R. A first linkage arm 232 of linkage arms 230 is rotatably connected to bearing 210. In particular, a first end portion 240 of first linkage arm 232 is positioned at and rotatably connected to bearing 210. A second linkage arm 234 of linkage arms 230 is rotatably connected to elongated shaft 220. In particular, a first end portion 250 of second linkage arm 234 is positioned at and rotatably connected to distal end portion 222 of elongated shaft 220. First linkage arm 232 is also rotatably connected to second linkage arm 234. In particular, a second end portion 242 of first linkage arm 232 is positioned at and rotatably connected to a second end portion 252 of second linkage arm 234.

In certain example embodiments, elongated shaft 220 includes a post 224 at distal end portion 222 of elongated shaft 220. Post 224 may extend or be elongated along the rotation axis R. Door 120 is rotatably connected to post 224 at one end of post 224, and second linkage arm 234 is rotatably connected to post 224 at the opposite end of post 224. For example, the one end of post 224 may be received within a hole defined by a bracket 124 of door 120 (e.g., on a top edge 126 of door 120), and the opposite end of post 224 may be received within a hole defined by second linkage arm 234 at first end portion 250 of second linkage arm 234.

First linkage arm 232 defines a length between first and second end portions 240, 242 of first linkage arm 232. Similarly, second linkage arm 234 defines a length between first and second end portions 250, 252 of second linkage arm 234. Distal end portion 222 of elongated shaft 220 is also spaced from bearing 210 by a gap G (FIG. 3) along the translation axis T when door 120 is closed. A sum of the length of first linkage arm 232 and the length of second linkage arm 234 is greater than the gap G. Thus, linkage arms 230 are angled relative to one another rather than being parallel when door 120 is closed, as shown in FIGS. 2 and 3.

The length of first linkage arm 232 and the length of second linkage arm 234 may be selected to induce door 120 to translate along the translation axis T as the door rotates from a closed position (shown in FIG. 3) towards an open position (shown in FIG. 5). For example, the length of first linkage arm 232 may be greater than the length of second linkage arm 234. In particular, the length of first linkage arm 232 may be no less than fifty percent (50%) greater than the length of second linkage arm 234 and, e.g., no more than one hundred percent (100%) greater than the length of second linkage arm 234. Such relative sizing between first and second linkage arms 232, 234 may facilitate translation of door 120 along the translation axis T as door 120 rotates open, e.g., while also providing a compact arrangement for linear hinge 200.

The length of second linkage arm 234 may also be oriented perpendicular to the translation axis T when door 120 is closed, as shown in FIGS. 2 and 3. As used herein the term "oriented perpendicular" does not require components to be angled at exactly ninety degrees (90°) and rather encompasses a ten degree (10°) margin. The sizing and/or orientation of second linkage arm 234 may be selected such that second end portion 244 of first linkage arm 232 and second end portion 254 of second linkage arm 234 may be positioned no more than a quarter of an inch (0.25") from a side 122 of door 120 when door 120 is closed. Thus, e.g., linkage arms 230 may not significantly overhang side 122 of door 120, as shown in FIG. 3.

First linkage arm 232 may include a pinch guard 260. Pinch guard 260 is positioned over a portion of elongated shaft 220 between bearing 210 and distal end portion 222 of elongated shaft 220 when door 120 is closed. Thus, pinch guard 260 may block fingers from being inserted between elongated shaft 220 and linkage arms 230 when door 120 is opened and/or closed. Pinch guard 260 may have a circular segment shape and/or may be a single piece of metal. Thus, pinch guard 260 may be integrally formed with first linkage arm 232 in certain example embodiments.

Elongated shaft 220 may also define a slot 226 that extends along the translation axis T on elongated shaft 220. Bearing 210 may have a guide 212 positioned within slot 210. Guide 212 may be a pin, shaft, etc. that constrains rotation of elongated shaft 220. In particular, guide 212 is configured to prevent rotation of elongated shaft 220 on bearing 210, e.g., about the translation axis T. Thus, e.g., interference between guide 212 and elongated shaft 220 at slot 210 may block rotation of elongated shaft 220 relative bearing 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet;

a door;

a linear hinge coupling the door to the cabinet, the linear hinge comprising a bearing mounted to the cabinet;

an elongated shaft received within the bearing such that the elongated shaft is slidable along a translation axis on the bearing, a distal end portion of the elongated shaft rotatably connected to the door such that the door is rotatable about a rotation axis that extends through the distal end portion of the elongated shaft;

a pair of linkage arms, a first linkage arm of the pair of linkage arms rotatably connected to the bearing such that a first end portion of the first linkage arm is positioned at the bearing, a second linkage arm of the pair of linkage arms rotatably connected to the elongated shaft such that a first end portion of the second linkage arm is positioned at the distal end portion of the elongated shaft, the first linkage arm rotatably connected to the second linkage arm such that a second end portion of the first linkage arm is positioned at a second end portion of the second linkage arm, wherein the first linkage arm defines a length between the first and second end portions of the first linkage arm, and the second linkage arm defines a length between the first and second end portions of the second linkage arm, and wherein the distal end portion of the elongated shaft is spaced from the bearing by a gap along the translation axis when the door is closed, and a sum of the length of the first linkage arm and the length of the second linkage arm is greater than the gap.

2. The appliance of claim 1, wherein the length of the second linkage arm is oriented perpendicular to the translation axis when the door is closed.

3. The appliance of claim 1, wherein the length of the first linkage arm is greater than the length of the second linkage arm.

4. The appliance of claim 3, wherein the length of the first linkage arm is no less than fifty percent greater than the length of the second linkage arm.

5. The appliance of claim 1, wherein the elongated shaft comprises a post at the distal end portion of the elongated shaft that extends along the rotation axis, the door is rotatably connected to the post at one end of the post, and the second linkage arm is rotatably connected to the post at the opposite end of the post.

6. The appliance of claim 1, wherein the first linkage arm comprises a pinch guard positioned over a portion of the elongated shaft between the bearing and the distal end portion of the elongated shaft when the door is closed.

7. The appliance of claim 6, wherein the pinch guard has a circular segment shape.

8. The appliance of claim 7, wherein the first linkage arm is a single piece of metal.

9. The appliance of claim 1, wherein the elongated shaft defines a slot that extends along the translation axis, and the bearing comprises a guide positioned within the slot and configured to prevent rotation of the elongated shaft on the bearing.

10. The appliance of claim 1, wherein the second end portion of the first linkage arm and the second end portion of the second linkage arm are positioned no more than a quarter of an inch from a side of the door when the door is closed.

11. The appliance of claim 1, wherein the length of the first linkage arm and the length of the second linkage arm are selected such that the door translates along the translation axis as the door rotates from a closed position towards an open position.

12. An appliance, comprising:

a cabinet;

a door;

a linear hinge coupling the door to the cabinet, the linear hinge comprising a bearing mounted to the cabinet;

an elongated shaft received within the bearing such that the elongated shaft is slidable along a translation axis on the bearing, a distal end portion of the elongated shaft rotatably connected to the door such that the door is rotatable about a rotation axis that extends through the distal end portion of the elongated shaft;

a pair of linkage arms, a first linkage arm of the pair of linkage arms rotatably connected to the bearing such that a first end portion of the first linkage arm is positioned at the bearing, a second linkage arm of the pair of linkage arms rotatably connected to the elongated shaft such that a first end portion of the second linkage arm is positioned at the distal end portion of the elongated shaft, the first linkage arm rotatably connected to the second linkage arm such that a second end portion of the first linkage arm is positioned at a second end portion of the second linkage arm, wherein the first linkage arm defines a length between the first and second end portions of the first linkage arm, the second linkage arm defines a length between the first and second end portions of the second linkage arm, and the length of the second linkage arm is oriented perpendicular to the translation axis when the door is closed, and wherein the distal end portion of the elongated shaft is spaced from the bearing by a gap along the translation axis when the door is closed, and a sum of the length of the first linkage arm and the length of the second linkage arm is greater than the gap, and wherein the length of the first linkage arm is greater than the length of the second linkage arm, and the length of the first linkage arm and the length of the second linkage arm are selected such that the door translates along the translation axis as the door rotates from a closed position towards an open position.

13. The appliance of claim 12, wherein the length of the first linkage arm is no less than fifty percent greater than the length of the second linkage arm.

14. The appliance of claim 12, wherein the elongated shaft comprises a post at the distal end portion of the elongated shaft that extends along the rotation axis, the door is rotatably connected to the post at one end of the post, and the second linkage arm is rotatably connected to the post at the opposite end of the post.

15. The appliance of claim 12, wherein the first linkage arm comprises a pinch guard positioned over a portion of the elongated shaft between the bearing and the distal end portion of the elongated shaft when the door is closed.

16. The appliance of claim 15, wherein the pinch guard has a circular segment shape, and the first linkage arm is a single piece of metal.

17. The appliance of claim 12, wherein the elongated shaft defines a slot that extends along the translation axis, and the bearing comprises a guide positioned within the slot and configured to prevent rotation of the elongated shaft on the bearing.

18. The appliance of claim 12, wherein the second end portion of the first linkage arm and the second end portion of the second linkage arm are positioned no more than a quarter of an inch from a side of the door when the door is closed.

* * * * *